US007266945B2

(12) United States Patent
Sanders

(10) Patent No.: US 7,266,945 B2
(45) Date of Patent: Sep. 11, 2007

(54) FUEL INJECTION APPARATUS

(75) Inventor: Noel A. Sanders, Derby (GB)

(73) Assignee: Rolls-Royce plc, London (GB)

( * ) Notice: Subject to any disclaimer, the term of this patent is extended or adjusted under 35 U.S.C. 154(b) by 265 days.

(21) Appl. No.: 11/116,259

(22) Filed: Apr. 28, 2005

(65) Prior Publication Data

US 2006/0021350 A1 Feb. 2, 2006

Related U.S. Application Data

(63) Continuation-in-part of application No. 10/628,465, filed on Jul. 29, 2003, now abandoned.

(30) Foreign Application Priority Data

Aug. 21, 2002 (GB) ..... 0219458.7

(51) Int. Cl.
*F02C 7/22* (2006.01)

(52) U.S. Cl. ..... 60/743

(58) Field of Classification Search ..... 60/734, 60/740, 742, 743, 776
See application file for complete search history.

(56) References Cited

U.S. PATENT DOCUMENTS 4,970,865 A * 11/1990 Shekelton et al. ..... 60/757
5,267,442 A * 12/1993 Clark ..... 60/748

* cited by examiner

*Primary Examiner*—L. J. Casaregola
(74) *Attorney, Agent, or Firm*—W. Warren Taltavull; Manelli Denison & Selter PLLC

(57) ABSTRACT

A fuel injection apparatus (10) for a gas turbine engine (110) comprising a prefilmer (26), the prefilmer (26) comprises a body (50), the body (50) defines an axis (51), an annular surface (40) and a downstream edge (44), the prefilmer (26) arranged so that when working in operative association with the fuel injection apparatus (10) fuel impinges on the surface (40) and flows, by means of a passing airflow, to the downstream edge (44), from where the fuel is shed, characterized in that the fuel injector (10) further comprises a means for circumferentially varying the residence time of the fuel across the surface (40).

9 Claims, 5 Drawing Sheets

Fig.3.b.

FUEL INJECTION APPARATUS

This is a Continuation-in-Part National application Ser. No. 10/628,465 filed Jul. 29, 2003 now abandoned.

FIELD OF THE INVENTION

The present invention relates to a fuel injection apparatus for a combustor of a gas turbine engine and in particular a prefilmer thereof.

BACKGROUND OF THE INVENTION

There is an increasing demand to reduce the emissions produced by gas turbine combustors for aerospace, marine and industrial applications. One approach is to use lean premixed pre-vaporised (LPP) combustion in which liquid fuel is mixed and evaporated within a premixing duct. A typical LLP fuel injection apparatus is disclosed in EP0660038. The fuel-air mixture then flows into the combustion chamber where it is burnt. Low levels of oxides of nitrogen (NOx) emissions are obtained because the premixer produces a uniformly mixed fuel-air mixture at an equivalence ratio less than stoichiometric. This mixture burns at a relatively low flame temperature avoiding the NOx producing high temperature volumes of more conventional combustion systems.

To assist mixing, many premixing ducts incorporate a prefilmer mounted within the duct. This is usually disposed between radially adjacent swirl vanes. Fuel is shed from the downstream edge of the prefilmer, and is atomised as it passes through a shear region formed by the swirl vanes. In this way, fuel is always distributed from the centre of the duct and the chance of poor mixing due to over or under fuel penetration is avoided. In a typical LPP fuel injector this is the only purpose of the prefilmer.

Although LPP combustion systems can produce NOx emissions levels significantly lower than conventional combustion systems, there are severe disadvantages. One of these is combustion instability. Where variations in heat release and pressure are in phase, the magnitude of both fluctuations will increase. The severity of the combustion instability produced varies from an irritating noise to a force powerful enough to stall gas turbine compressors and cause structural damage to combustion systems. In a conventional aerospace gas turbine combustion system, different areas within the combustor operate at different air-fuel ratios. Here, fluctuations in heat release become out of phase relative to each other resulting in a reduction of the net heat-release. In an LPP system, as the system runs at a uniform air-fuel ratio, all parts of the combustion system tend to oscillate in phase with each other. Net heat release fluctuations therefore tend to be high.

SUMMARY OF THE INVENTION

Therefore an object of the present invention is to provide a means for reducing combustion instability and in particular reducing net heat release fluctuations within the combustor.

Accordingly the present invention seeks to provide a fuel injection apparatus for a gas turbine engine comprising a prefilmer, the prefilmer comprises a body, the body defines an axis, an annular surface and a downstream edge, the prefilmer arranged so that when working in operative association with the fuel injection apparatus fuel impinges on the surface and flows, by means of a passing airflow, to the downstream edge, from where the fuel is shed, characterised in that the fuel injector further comprises a means for circumferentially varying the residence time of the fuel across the surface.

Preferably, the fuel injector comprises a fuel outlet passage that is arranged to spray fuel onto the surface, the means for circumferentially varying the residence time of the fuel across the surface comprises the fuel outlet passage having a circumferentially varied axial position so that fuel is sprayed on to the surface in at least two different axial positions.

Alternatively, the means for varying the residence time of the fuel on the surface comprises the surface having a circumferentially varied axial length so that fuel shed from the downstream edge is shed from at least two different axial positions. Preferably the surface is of a generally sinusoidal form or alternatively the surface is crenellated, generally saw-toothed form, scarfed, comprises arcuate portions or defines a spiral.

Alternatively, the means for varying the residence time of the fuel on the surface comprises the surface having at least one roughness patch.

Alternatively, the means for varying the residence time of the fuel on the surface is asymmetrically arranged about the fuel injection apparatus.

Alternatively, the means for circumferentially varying the residence time of the fuel across the surface comprises the fuel outlet passage arranged generally in one axial plane and configured to spray the fuel at more than one angle therefrom so that fuel impinges on the surface in at least two different axial positions and the residence time of the fuel across the surface varies circumferentially.

Alternatively, the fuel outlet passage comprises at least two angled portions, the angle of each being between 45 and 135 degrees.

BRIEF DESCRIPTION OF THE DRAWINGS

FIGS. 3*a-i* show nine embodiments of the prefilmer in accordance with the present invention.

DETAILED DESCRIPTION OF THE INVENTION

Figure 1:
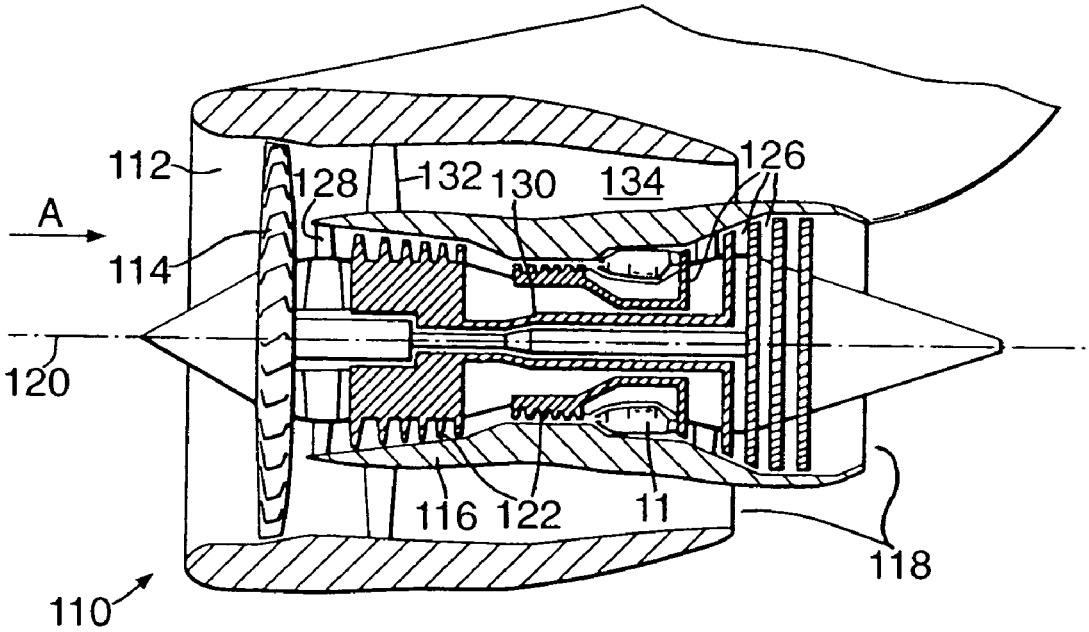
FIG. 1 is a schematic section of a ducted fan gas turbine engine incorporating an embodiment of the present invention.

With reference to FIG. 1 a ducted fan gas turbine engine 110 comprises, in axial flow series an air intake 112, a propulsive fan 114, a core engine 116 and an exhaust nozzle assembly 118 all disposed about a central engine axis 120. The core engine 16 comprises, in axial flow series, a series of compressors 122, a combustor 124, and a series of turbines 126. The direction of airflow through the engine 110 in operation is shown by arrow A. Air is drawn in through the air intake 112 and is compressed and accelerated by the fan 114. The air from the fan 114 is split between a core engine flow and a bypass flow. The core engine flow passes through an annular array of stator vanes 128 and enters core engine 116, flows through the core engine compressors 122 where it is further compressed, and into the combustor 124 where it is mixed with fuel, which is supplied to, and burnt within the combustor 124. Combustion of the fuel mixed with the compressed air from the compressors 122 generates a high energy and velocity gas stream that exits the combustor 124 and flows downstream through the turbines 126. As the high energy gas stream flows through the turbines 126 it rotates turbine rotors extracting energy from the gas stream which is used to drive the fan 114 and compressors 122 via engine shafts 130 which drivingly connect the turbine 126 rotors with the compressors 122 and fan 114. Having flowed through the turbines 126 the high energy gas stream from the combustor 122 still has a significant amount of energy and velocity and it is exhausted, as a core exhaust stream, through the engine exhaust nozzle assembly 118 to provide propulsive thrust. The remainder of the air from, and accelerated by, the fan 114 flows through an annular array of guide vanes 132 within a bypass duct 134 around the core engine 116. This bypass airflow, which has been accelerated by the fan 114, flows to the exhaust nozzle assembly 118 where it is exhausted, as a bypass exhaust stream to provide further, and in fact the majority of, the useful propulsive thrust. The combustor 124 incorporates a fuel injector (not shown), which is in accordance with the present invention.

Figure 2:
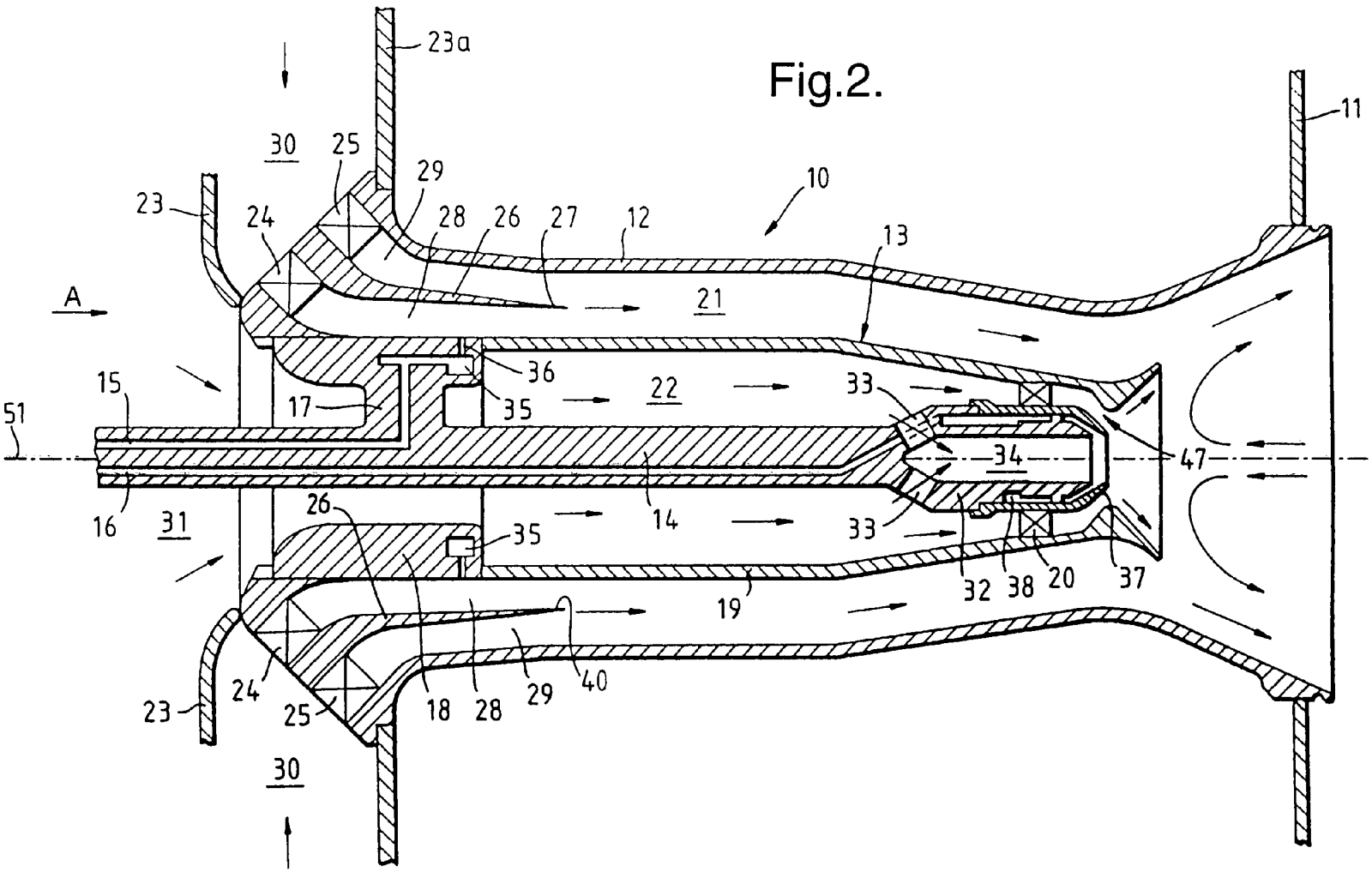
FIG. 2 is a cross-sectional side view of a fuel injection apparatus in accordance with the present invention attached to the upstream end of a combustion chamber.

Referring now to FIG. 2, a fuel injection apparatus suitable for the gas turbine engine 110 is generally indicated at 10. The fuel injection apparatus 10, described with reference to FIG. 2, is that disclosed in EP0660038.

The fuel injection apparatus 10 is attached to the upstream end of the gas turbine engine combustion chamber 11, part of which can be seen in FIG. 2. Throughout this specification, the terms "upstream" and "downstream" are used with respect to the general direction of a flow of liquid and gaseous materials through the fuel injection apparatus 10 and the combustion chamber 11 as shown by arrow A. Thus with regard to the accompanying drawings, the upstream end is towards the left hand side of the drawing and the downstream end is towards the right hand side. The actual configuration of the combustion chamber 11 is conventional and will not, therefore, be described in detail. Suffice to say, however, that the combustion chamber 11 may be of the well known annular type or alternatively of the cannular type so that it is one of an annular array of similar individual combustion chambers or cans. In the case of a cannular combustion chamber, one fuel injection apparatus 10 would normally be provided for each combustion chamber 11. However, in the case of an annular combustion chamber 11, the single chamber would be provided with a plurality of fuel injection apparatus 10 arranged in an annular array at its upstream end. Moreover, more than one such annular array could be provided if so desired. For instance, there could be two coaxial arrays.

The fuel injection apparatus 10 comprises an axisymmetric mixing duct 12 within which a centrebody 13 is coaxially located.

The centrebody 13 in turn comprises a central axially elongate core 14 that contains first and second fuel supply ducts 15 and 16. The upstream end of the core 14 is provided with an integral radially extending strut 17 that interconnects the centrebody 14 with a support ring 18. The strut 17 is integral with the support ring 18.

The support ring 18 supports the upstream end of a cowl 19 that defines the radially outer surface of the centrebody 13. The downstream end of the cowl 19 is supported by the downstream end of the core 14 by way of a plurality of generally radially extending swirler vanes 20. A first annular passage 21 is thereby defined between the mixing duct 12 and the cowl 19. Similarly a second annular passage 22 is defined between the cowl 19 and the core 14.

Air under pressure is supplied to an annular region 30 that is upstream of the major portion of the fuel injection apparatus 10. Two generally radially extending axially spaced apart walls 23 and 23*a* define the region 30. The further downstream wall, wall 23*a*, additionally supports the upstream end of the fuel injection apparatus 10. The high-pressure air is, in operation, supplied by the series of compressors 122 of the gas turbine engine 110 to the fuel injection apparatus 10.

The mixing duct 12 has two annular arrays of swirler vanes 24 and 25 at its upstream end that are separated by an annular prefilmer 26. The annular prefilmer 26 extends downstream of the swirler vanes 24 and 25 to terminate with an annular downstream edge 27. The annular divider 26 thereby divides the upstream end of the annular passage 21 into two coaxial parts 28 and 29, which are of generally equal radial extent. It will be seen therefore that pressurised air from the region 30 flows over the swirler vanes 24 and 25 to create two coaxial swirling flows of air, which are initially divided by the annular prefilmer 26. The two swirling flows of air then combine in the annular passage 21 downstream of the annular downstream edge 27 of the prefilmer 26. The swirler vanes 24 and 25 may be so configured that the two flows of air are either co-swirling or contra-swirling.

A further region 31, which is defined by the wall 23, also contains pressurised air. Air, from region 31, flows through the centre of the support ring 18 and then into the second annular space 22. It then proceeds to flow through the annular space 22 until it reaches the enlarged downstream end 32 of the central core 14. There the airflow is divided. One portion of the airflow passes over the swirl vanes 20 which support the downstream end of the core 14 and is thereby swirled. The swirling air flow is then exhausted from the downstream end of the centrebody 13 whereupon it mixes with air exhausting from the annular passage 21. The remaining portion of the air flowing through the annular passage 22 flows through holes 33 provided in the core 14 to enter a passage 34 located within the central core downstream end 32. The airflow is subsequently discharged from the downstream end of the passage 34 where it mixes with the swirling air flow exhausting from the swirler vanes 20. The radially inner surface of the downstream end of the centre body 13 is of convergent-divergent configuration as indicated at 34 so as to promote such mixing.

The first fuel duct 15 directs liquid fuel through the strut 17 to an annular gallery 35 that is situated close to the radially outer surface of the support ring 18. A plurality of radially extending, small diameter passages 36 interconnect the annular gallery 35 with the radially outer surface of the support ring 18. The passages 36 permit fuel to flow from the annular gallery 35 into the part 28 of the annular passage 21. There the fuel encounters the swirling flow of air exhausted from the swirler vanes 24. Some of that fuel is evaporated by the air flow and proceeds to flow in a downstream direction through the annular passage 21. The remainder of the fuel, which by this time is in the form of droplets, impinges upon the radially inner surface 40 of a body 50 which defines the annular prefilmer 26. There it forms a film of liquid fuel, which then proceeds to flow in a downstream direction over the radially inner surface of the annular prefilmer 26. The fuel film runs to and is shed from the annular downstream edge 27 at the downstream end of the annular prefilmer 26. Here the fuel film encounters the swirling flow of air which has been exhausted from the swirler vanes 25 and flowed over the radially outer surface of the annular prefilmer 26.

It will be appreciated that although fuel is described as being directed across the swirling flow of air exhausted from the swirler vanes 24 on to the radially inner surface 40 of the prefilmer 26, this is not in fact essential. For instance fuel could be directed on to the radially inner, or indeed radially outer, surface of the prefilmer 26 through the fuel passages provided within the prefilmer 26.

The adjacent swirling air flows over the radially inner and outer surfaces of the annular prefilmer 26 atomising the fuel as it flows off the annular lip 27. The atomised fuel is then quickly evaporated by the airflow exhausted from the swirler vanes 25 before passing into the major portion of the annular space 21. The annular passage 21 is of sufficient length to ensure that the evaporated fuel, and the swirling flows of air which carry it, are thoroughly mixed by the time they reach the downstream end of the duct 12. In order to further enhance the mixing process the duct 12 is of generally convergent-divergent configuration. The divergent outlet of the duct 12 also ensures flame recirculation in the outer region, thereby ensuring in turn the necessary flame stability within the combustion chamber 124.

The thorough mixing of fuel and air in the annular passage 21 ensures that the resultant fuel/air mixture, which is subsequently directed into the combustion chamber 124, does not contain significant localised high concentrations of fuel, either in the form of vapour or droplets. This ensures that local areas of high temperature within the combustion chamber 124 are avoided, so in turn minimizing the production of oxides of nitrogen. Additionally, since no liquid fuel is deposited upon the radially inner surface of the duct 12, liquid fuel cannot flow along that wall and into the combustion chamber 124 to create local areas of high temperature. The fuel/air mixture exhausted from the annular passage 21 is primarily for use when the gas turbine engine which include the fuel injection apparatus 10 is operating under full power or high speed cruise conditions. However, under certain other engine operating conditions, primarily engine light-up and low power operations, the fuel/air flow from the annular passage 21 is not ideally suited to efficient engine operation. Under these conditions, fuel is additionally directed through the second fuel supply duct 16.

The second fuel supply duct 16 extends through virtually the whole length of the central core 14. Where it reaches the downstream end 32 of the central core 14, it passes around the holes 33 in the core end 32 to terminate in an annular gallery 38. The annular gallery 38 is defined by the radially outer surface of the core end 32 and an annular cap 37 which fits over the core end 32 in radially spaced apart relationship therewith.

The downstream ends of the core end 32 and the cap 37 are convergent to the same degree so that fuel in the annular gallery 38 is exhausted therefrom in a radially inward direction. The fuel is thus directed as a film into the path of the previously mentioned air flow which is exhausted from the downstream end of the passage 34. This causes atomisation of the fuel whereupon the resultant fuel/air mixture mixes with the swirling air flow exhausted from the swirler vanes 20 to cause vaporisation of the fuel. The fuel/air mixture then passes into the combustion chamber 124 where combustion takes place. As in the case of the downstream end of the duct 12, the internal surface of the downstream end of the cowl 19 is divergent at 47 so as to ensure recirculation and hence flame stability.

The fuel supply to the first and second fuel supply ducts 15 and 16 is modulated by conventional means (not shown) so that some or all of the fuel supply to the fuel injection apparatus 10 flows through each of the ducts 15 and 16. Typically therefore under engine starting and low power conditions, all or most of the fuel passes through the second duct 16 to be exhausted from the downstream end of the centrebody 13. However under high power and high speed cruise conditions, all or most of the fuel passes through the first duct 15 to be exhausted into the annular passage 21. There may be circumstances however in which it is desirable to direct fuel through both of the first and second ducts 15 and 16 at the same time, for instance under transitional conditions when the power setting of the gas turbine engine which includes the fuel injection apparatus 10 is changed.

When the fuel supply through either of the first and second fuel supply ducts 15 and 16 is cut off, the air flows through the passages 21 and 22 remain. This is important to ensure that those portions of the fuel injection apparatus 10 which are exposed to the hot combustion process within the combustion chamber 124 are cooled to prevent their damage. It may be desirable, however, to modulate the supply of air to the annular passage 21 in order to achieve efficient combustion. Such air supply modulation is well known in the art.

Although LPP combustion systems, such as the prior art device described above, can produce NOx emissions levels significantly lower than conventional combustion systems, they have severe disadvantages. One of these is combustion instability.

During testing of this prior art fuel injection apparatus 10, it has been found that using a single axial fuel injection plane, i.e. the annular downstream edge 27, there is a high degree of combustion instability. This is because pressure fluctuations, arising from the combusting fuel vapour, travel upstream into the premixing first annular passage 21 where they cause the air velocity within the axisymmetric mixing duct 12 to pulsate. The air mass flow past the fuel injection plane (27) therefore also varies. However, as the air-pressure fluctuations are small relative to the fuel injection pressure there is no accompanying change in instantaneous fuel-flow. Instead of producing a temporally uniform air-fuel ratio, the premixer produces a uniformly spatially mixed air-fuel ratio, varying cyclically in time at the pressure fluctuation frequency. As heat-release from the combustion process is closely related to air-fuel ratio, temporal variations in air-fuel ratio within the premixer produce temporal variations in heat-release within the combustor chamber 11. These in turn generate the pressure fluctuations within the combustion chamber that cause the air-fuel ratio within the mixing duct 12 to oscillate on the next cycle. Thus a feedback loop is established.

Where variations in heat release and pressure are in phase, the magnitude of both fluctuations will increase. The severity of the combustion instability produced varies from an irritating noise to a force powerful enough to stall gas turbine compressors and cause structural damage to combustion systems. In a conventional aerospace gas turbine combustion system, different areas within the combustor operate at different air-fuel ratios. Here, fluctuations in heat release become out of phase relative to each other resulting in a reduction of the net heat-release. In an LPP system, as the system runs at a uniform air-fuel ratio, all parts of the combustion system tend to oscillate in phase with each other. Net heat release fluctuations therefore tend to be high.

Therefore it is an object of the present invention to provide a means for reducing combustion instability and in particular reducing net heat release fluctuations within the combustor.

Figure 3A:
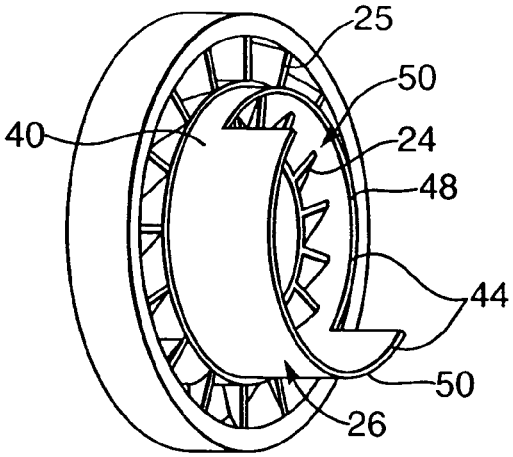
Figure 3A:
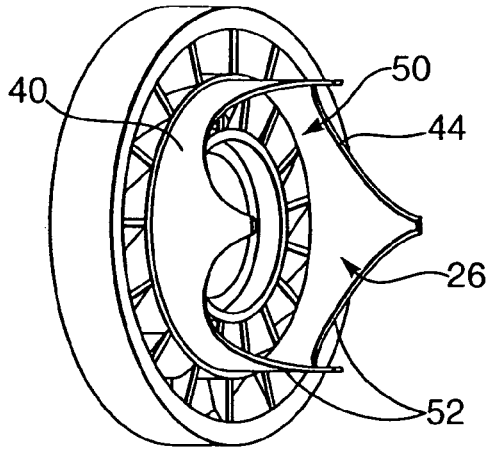
Figure 3C:
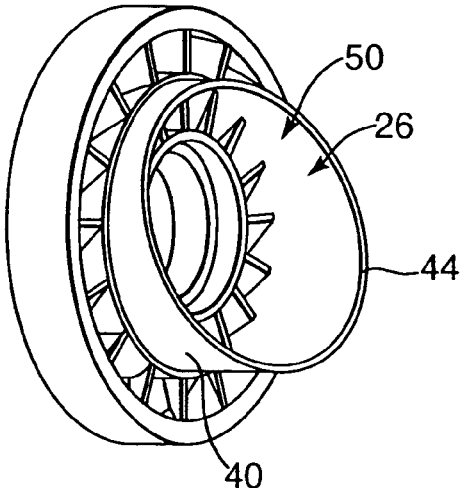

FIGS. 3*a-c* show three embodiments of a prefilmer assembly 42 in accordance with the present invention. The prefilmer assembly 42 is generally annular and comprises an annular prefilmer 26, having a downstream edge 44 and radially inner and outer swirler vanes 24, 25 disposed about a common axis 51. In these three embodiments the downstream edge 44 of the prefilmer 26 is not at a constant axial plane. Instead, the downstream edge 44 varies in axial position circumferentially which provides a means to vary the residence time of the fuel on the prefilmer as the fuel flows more slowly over the surface of the prefilmer than when it is in the air flow. The length of the prefilmer. 26 is therefore variable, depending upon circumferential position.

In operation, and as described with reference to FIG. 2, fuel is injected radially into the duct 28 from fuel outlet passages 36, impinging on the radially inner surface of the prefilmer 26. The fuel then runs along the axial length of the prefilmer 26 and is shed from its downstream edge 44. As the axial length of the prefilmer 26 varies with circumferential position, the residence time of the fuel on the prefilmer 26 and therefore the total residence time of the fuel within the mixing duct 21 also varies with circumferential position. This means that the fuel vaporises at different axial positions within the mixing duct 12 producing a non-uniformly spatially mixed air-fuel ratio, which therefore combusts in a non-uniform temporal manner thereby preventing the pressure fluctuations from establishing a feedback loop.

The prefilmer 26 still functions in a conventional manner, introducing fuel to the centre of the duct 21 while preventing over-penetration at high fuel flows.

With reference to FIG. 3*a*, the downstream edge 44 comprises two semi-circular portions 48, 50, each of different axial length. Further embodiments of the prefilmer 26 may comprises more than two portions, each portion differing in axial length. Alternatively, the downstream edge may be crenellated as shown in FIGS. 3*e* and 3*f*.

In FIG. 3*b* the downstream edge 44 defines arcuate portions 52 thus providing a smoothly varying downstream edge 44. This edge profile produces a high degree of variability in fuel residence time and therefore a highly non-uniform spatially mixed air-fuel ratio. Other similar profiles comprise a sinusoidal shaped and a saw-tooth shaped downstream edge 44, shown in FIGS. 3*g* and 3*h* respectively. The number and extent of the arcuate portions 52 will be dependent on each fuel injector application and such factors as the length of the pre-mixing duct and degree to which the airflow is swirled should be appreciated.

The prefilmer 26 shown in FIG. 3*c* comprises a downstream edge 44 that is scarfed 54. This edge profile again produces a high degree of variability in fuel residence time and therefore a highly non-uniform spatially mixed air-fuel ratio. Another similar profile, shown in FIG. 3*i*, includes a spiral downstream edge 44.

It would be obvious to one skilled in the art to understand the principal concept of providing a variable axial length prefilmer 26 to then design other profiles for the downstream edge 44, but it is intended that all such designs be within the scope and spirit of the present invention.

Figure 3D:
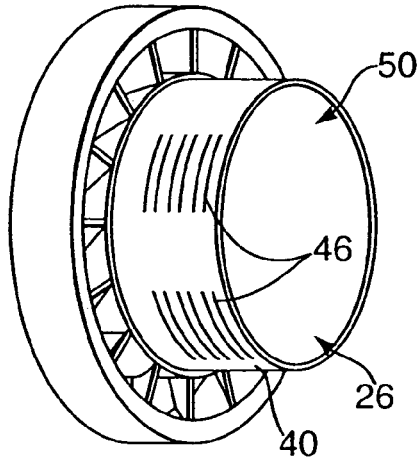
Figure 3E:
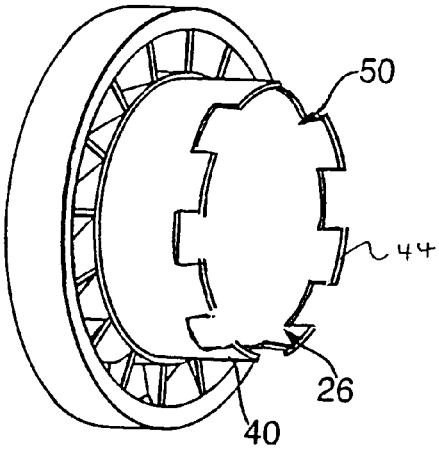
Figure 3F:
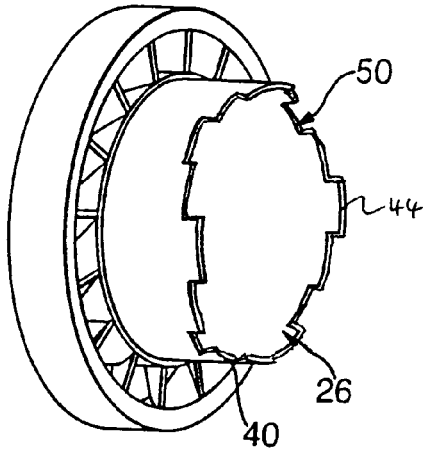
Figure 3I:
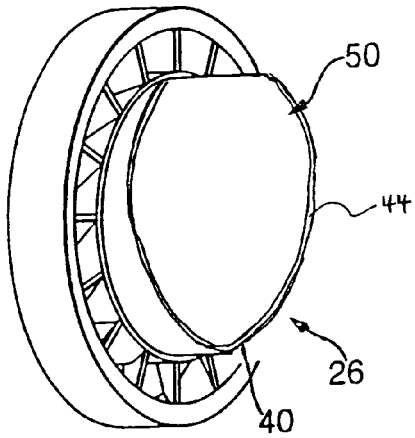
Figure 3G:
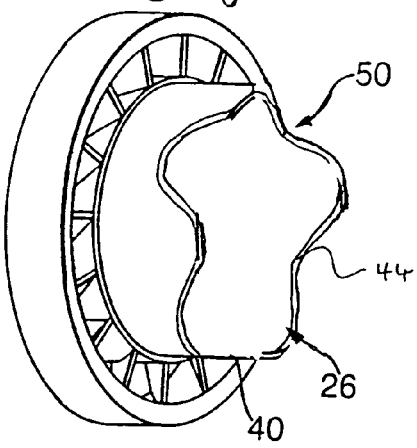
Figure 3H:
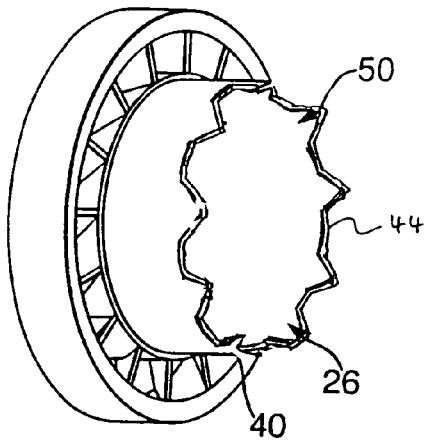

Referring to FIG. 3*d*, which is a fourth embodiment of the present invention, the prefilmer 26 comprises a downstream edge 44 which generally defines a constant axial plane. In this embodiment, the means to vary the residence time of the fuel on the prefilmer comprises variations of roughness of the surface of the prefilmer 26 over which the fuel flows. Roughness patches 46 are circumferentially spaced around the inner surface of the prefilmer 26. In this embodiment the roughness patches 46 comprises a series of shallow grooves 48 running generally circumferentially. It should be understood by the skilled reader that other forms of surface roughness may be introduced without departing from the scope of the present invention. The object of all forms of surface roughness is to slow the flow of fuel over that part of the surface of the prefilmer 26. Although this embodiment shows the roughness patches 46 equally spaced they may alternatively be unequally spaced around the circumference of the prefilmer 26.

For all these embodiments of the present invention, it is assumed that the premixing duct 12 is generally annular and that the prefilmer 26 used therewith is also generally annular. However, one skilled in the art to other injector 10 and prefilmer 26 shapes could equally apply the principals of the present invention. Furthermore, FIGS. 3*a-i* show the swirler vanes 24, 25 substantially parallel to the axis 120 and the prefilmer 26, as opposed to that shown in FIG. 2. It would be simple for the skilled artisan to modify the prefilmer assemblies of FIGS. 3*a-i* as a replacement for the prefilmer 26 of FIG. 2.

Figure 4:
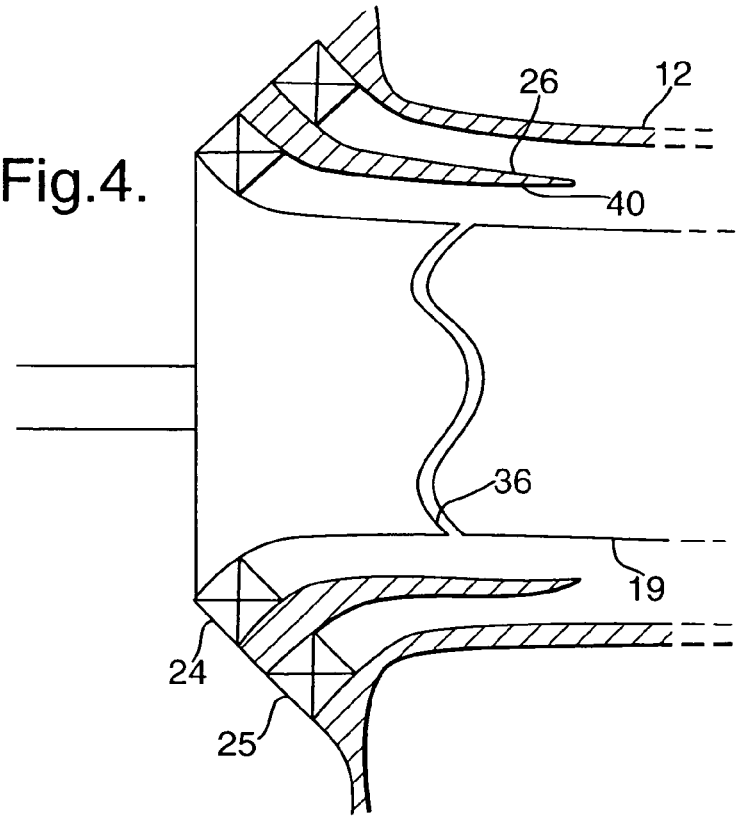
FIG. 4 is a partial cut away of part of the fuel injector of FIG. 2 incorporating fifth embodiment of the present invention.

Referring to FIG. 4, where the same reference numerals are used for the same elements as described with reference to FIG. 2. The means for circumferentially varying the residence time of the fuel across the surface 40 comprises the fuel outlet passage 36 arranged in a general sinusoidal configuration around the cowl 19. The fuel outlet passage 36 is arranged to spray fuel onto the surface 40, in use, such that fuel impinges on the prefilmer surface 40 in the form of a sinusoidal pattern around its circumference. Although not shown it should be obvious to one skilled in the art that this embodiment of the fuel outlet passage 36, is one of many that enables fuel to be sprayed on to the surface 40 in at least two different axial positions. For example, other arrangements comprise a "square wave" form, serrated configuration or an arrangement of generally circumferential slots where at least two of the slots are at different axial positions.

Figure 5:
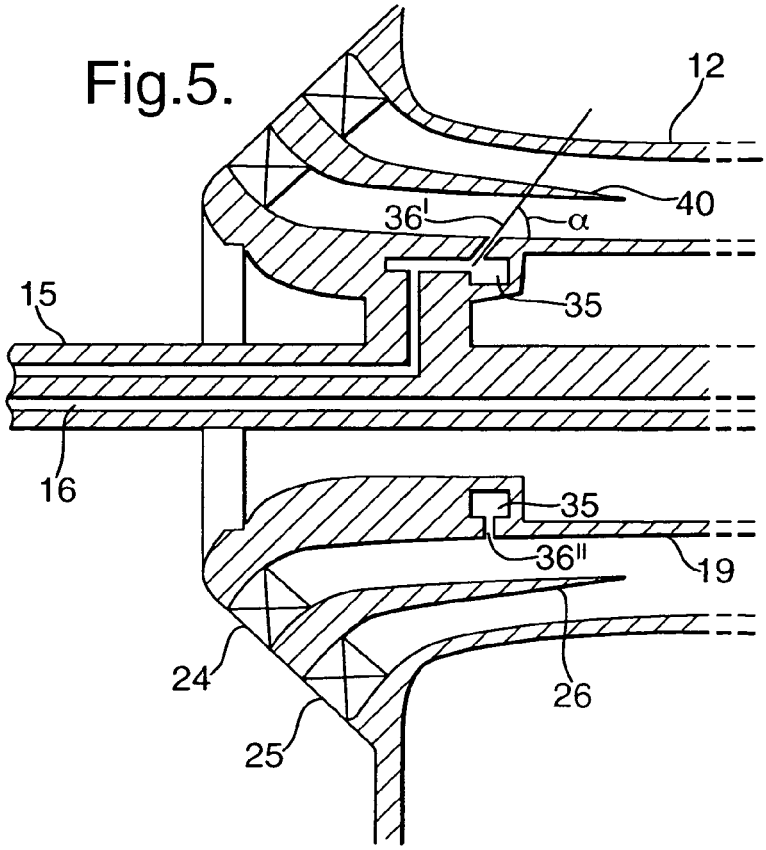
FIG. 5 is a cross-sectional side view of the fuel injector of FIG. 2 incorporating sixth embodiment of the present invention.

Referring to FIG. 5, where the same reference numerals are used for the same elements as described with reference to FIG. 2. The means for circumferentially varying the residence time of the fuel across the surface 40 comprises the fuel outlet passage 36 is arranged generally in one axial plane and is arranged to spray the fuel at more than one angle ($\alpha$) therefrom so that fuel impinges on the surface 40 in at least two different axial positions, therefore the residence time of the fuel across the surface 40 varies circumferentially. The upper part of FIG. 5 shows the fuel outlet passage 36', defined by the cowl 19, angled generally downstream whereas the at the lower part of the Figure the fuel outlet passage 36" is substantially perpendicular to the downstream direction.

There are many embodiments that are not described herein however, they do not depart from the spirit or scope of the present invention where the angle ($\alpha$) of the fuel outlet passage 36 comprises at least two different angled portions thereby impinging fuel on the surface 40 in at least two different axial positions, which circumferentially varies the residence time of the fuel across the surface 40. It should be appreciated that the angle ($\alpha$) of the fuel outlet passage 36 may vary around the circumference of the cowl 19. Determination of the angle ($\alpha$) comprises consideration of the air velocity through the injector 10, the axial length of the surface and the required variation of residence time on the surface 40. It is anticipated that a suitable range of angles ($\alpha$) is between 45-135 degrees.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A fuel injection apparatus for a gas turbine engine comprising a prefilmer, the prefilmer comprises a body, the body defining an axis, an annular surface and a downstream edge, the prefilmer arranged so that when working in operative association with the fuel injection apparatus fuel impinges on the surface and flows, by means of a passing airflow, to the downstream edge, from where the fuel is shed, characterised in that the fuel injector further comprises a means for circumferentially varying the residence time of the fuel across the surface wherein the means for varying the residence time of the fuel across the surface comprises the surface having a circumferentially varied axial length so that fuel shed from the downstream edge is shed from at least two different axial positions.

2. A fuel injection apparatus as claimed in claim 1 characterised in that the means for varying the residence time of the fuel on the surface is crenellated.

3. A fuel injection apparatus as claimed in claim 2 characterised in that the crenellations are of different axial positions so that there are at least three different axial positions.

4. A fuel injection apparatus as claimed in claim 1 characterised in that the means for varying the residence time of the fuel on the surface is of a generally sinusoidal form.

5. A fuel injection apparatus as claimed in claim 1 characterised in that the means for varying the residence time of the fuel on the surface is of a generally saw-toothed form.

6. A fuel injection apparatus as claimed in claim 1 characterised in that the means for varying the residence time of the fuel on the surface is scarfed.

7. A fuel injection apparatus as claimed in claim 1 characterised in that the means for varying the residence time of the fuel on the surface comprises a surface that defines arcuate portions.

8. A fuel injection apparatus as claimed in claim 1 characterised in that the means for varying the residence time of the fuel on the surface defines a spiral.

9. A fuel injection apparatus as claimed in claim 1 characterised in that the means for varying the residence time of the fuel on the surface is asymmetrically arranged about the fuel injection apparatus.

* * * * *